United States Patent [19]

Pickering et al.

[11] Patent Number: 4,704,311

[45] Date of Patent: Nov. 3, 1987

[54] PROCESS FOR MAKING ELECTRICALLY CONDUCTIVE TEXTILE FILAMENTS

[75] Inventors: Trevor P. Pickering, Williamsburg; George A. Paton, Newport News; James A. Gusack; Thomas E. Smith, both of Williamsburg; John H. Sanders, Newport News; Sterling M. Nichols, Williamsburg; Johnson L. Pursoo, Newport News; John W. Lindsay; William E. Streetman, both of Williamsburg, all of Va.

[73] Assignee: BASF Corporation, Williamsburg, Va.

[21] Appl. No.: 804,562

[22] Filed: Dec. 4, 1985

[51] Int. Cl.[4] ..... B05D 5/12; B05D 1/28; B05D 3/02

[52] U.S. Cl. ..... 427/393.1; 28/274; 427/177; 427/428

[58] Field of Search ..... 427/122, 175, 393.1, 427/177, 428; 118/234; 28/274

[56] References Cited

U.S. PATENT DOCUMENTS 4,255,487 3/1981 Sanders ..... 428/368

FOREIGN PATENT DOCUMENTS 744527 2/1956 United Kingdom ..... 118/234

OTHER PUBLICATIONS

*Materials in Design Engineering,* Materials Selector Issue, Mid-Oct. 1966-1967, pp. 235-236.

*Primary Examiner*—Evan K. Lawrence

*Attorney, Agent, or Firm*—Rubert B. Hurley; Edward F. Sherer; Tom R. Vestal

[57] ABSTRACT

This process for making antistatic filaments utilizes a specific mixture of compounds in order to suffuse electrically conductive particles into a filamentary polymeric substrate by forwarding the substrate through a grooved roll-type mix applicator. The mixture comprises a dispersion of the electrically conductive particles in liquid solvent which is a mixture of formic acid and a member selected from the group consisting of an amide, a carboxylic acid other than formic acid, an alcohol, an ester, a ketone, an ether, and a hydrocarbon. The process provides advantages over the prior art in permitting the use of high processing speeds, enabling easy stringup, and allowing the use of knotty and/or slubby filamentary substrates.

18 Claims, 5 Drawing Figures

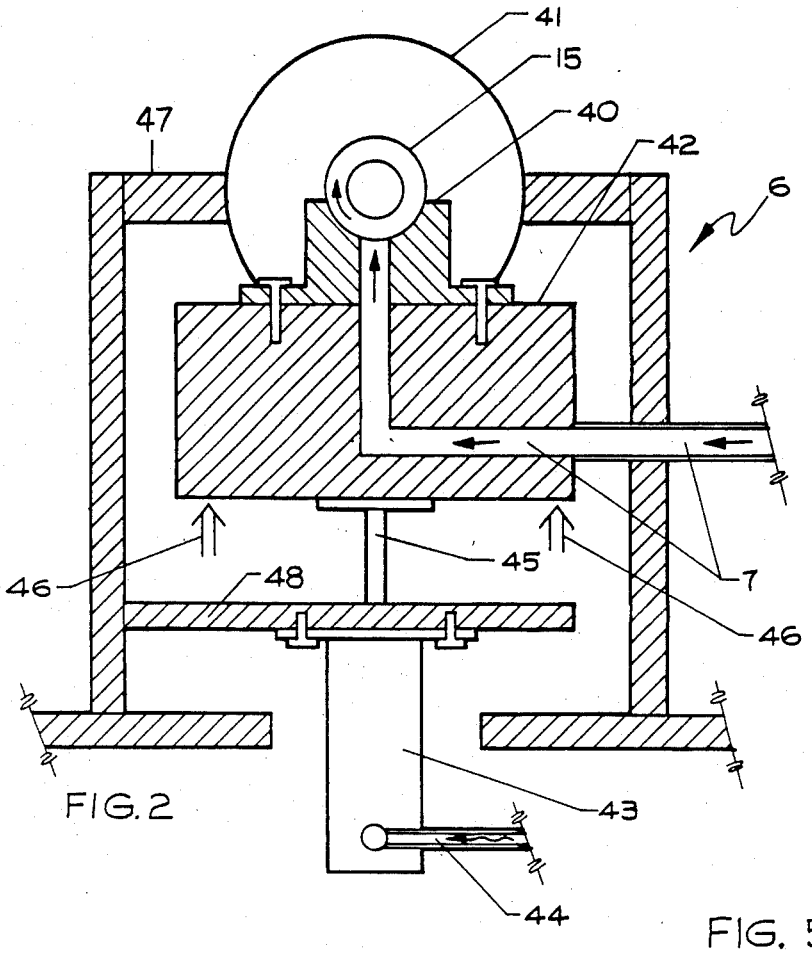
FIG. 2
FIG. 5
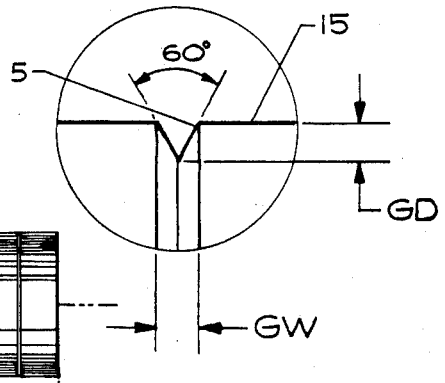
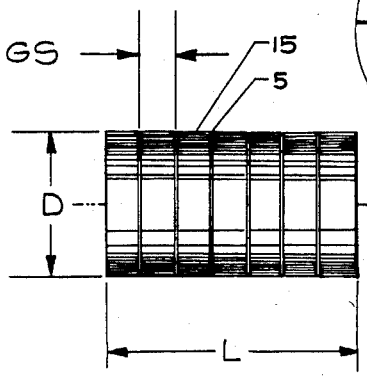
FIG. 4

PROCESS FOR MAKING ELECTRICALLY CONDUCTIVE TEXTILE FILAMENTS

BACKGROUND OF THE INVENTION

1. Field of the Invention

The present invention pertains to processes for the production of antistatic filaments using specific apparati for carrying out these processes. The apparatus which is most preferred is classified under coating apparatus having a solid applicator which supports strand form work. The applicator is movably mounted, rotates, and utilizes force or fountain feed.

2. Description of the Prior Art

The closest prior art patents with respect to the present invention are U.S. Pat No. 3,823,035 and U.S. Pat. No. 4,255,487, and U.S. Pat. No. 4,545,835 which are hereby incorporated by reference. These patents describe broad, generalized processes for making antistatic filaments which are virtually identical to the filaments made by the process of the present invention. However, these processes differ from the process of the instant invention in that different mixes are applied and different mix application means are utilized, as described in detail below.

Other patents which are much more distantly related to the present invention include: U.S. Pat. No. 3,582,445; U.S. Pat. No. 3,040,703; U.S. Pat. No. 3,749,055; U.S. Pat. No. 2,269,150; U.S. Pat. No. 2,380,422; U.S. Pat. No. 3,971,202 and U.S. Pat. No. 3,401,542. Most of these patents described filament coating means which are closely related to the coating means described herein.

BRIEF SUMMARY OF THE INVENTION

The present invention pertains to an improved process for making conductive textile fiber by suffusing a dispersion of finely-divided, electrically-conductive particles into a non-conductive, filamentary polymer substrate. The particles are applied to the substrate in an amount sufficient to render the electrical resistance of the textile not more than about $10^9$ ohms/cm in a liquid which is a solvent for the substrate but does not react with the electrically conductive particles. The solvent is removed from the substrate after a desired degree of penetration has taken place in the annular region located at the periphery of the filament and before the structural integrity of the substrate has been destroyed. The improvement found in the present invention comprises: applying a mix to the nonconductive filamentary substrate with a grooved, roll-type mix applicator, the mix being comprised of a dispersion of electrically conductive particles in a liquid solvent wherein the liquid solvent will dissolve the substrate and will flash evaporate at 150° C., and wherein the solvent is a mixture of formic acid and member selected from the group consisting of:

(a) an amide;
(b) a carboxylic acid;
(c) an alcohol;
(d) an ester;
(e) a ketone;
(f) an ether; and
(g) a hydrocarbon.

The improved process of the present invention allows one to produce a conductive textile fiber at a considerably greater speed and with a shorter evaporation tube than the processes exemplified in U.S. Pat. No. 3,823,035, U.S. Pat. No. 4,255,487 and U.S. Pat. No. 4,545,835. Furthermore, the mix utilized in the present invention provides a combination of volatility, surface tension, and viscosity which not only permits the carrying out of the process at high speeds but also allows the use of a roll-type mix applicator. The roll-type applicator is advantageous in that its use in turn permits the passage of slubs, knots, etc. found in the feed yarns without disruption of the process: e.g. a "transfer tail" on a feed yarn parkage may be tied to the leading end of another feed yarn package, so that a constant supply of feed yarn may be maintained. Knots and slubs create severe problems in the "orifice" processes described in U.S. Pat. No. 4,545,835.

It is an object of the present invention to provide an improved mix for the production of a conductive textile fiber so that the conductive textile fiber may be made at higher speeds than ever before.

It is an object of the present invention to provide an improved mix for the production of a conductive textile fiber so that a roll-type mix-applicator may be utilized in a commercial process in order that a slubby and/or knotty supply of feed yarn may be processed continuously without disruption of the process.

It is a further object of the present invention to enable a high-speed, substantially horizonal process for making a conductive textile fiber.

It is a further object of the present invention to enable the production of a supported conductive textile yarn at high speeds, i.e. speeds greater than 2000 m/min., the supported yarn being comprised of a conductive textile fiber being interlaced with a plurality of support strands.

BRIEF DESCRIPTION OF THE DRAWINGS

FIG. 2 is a cross-sectional view of a roll-type mix applicator to be used in the present invention.

FIG. 4 is a longitudinal perspective view of a grooved roller to be used in the process of the present invention.

FIG. 5 is an enlarged sectional view of a portion of the grooved roller illustrated in FIG. 4.

DETAILED DESCRIPTION OF THE PREFERRED EMBODIMENTS

Figure 1:
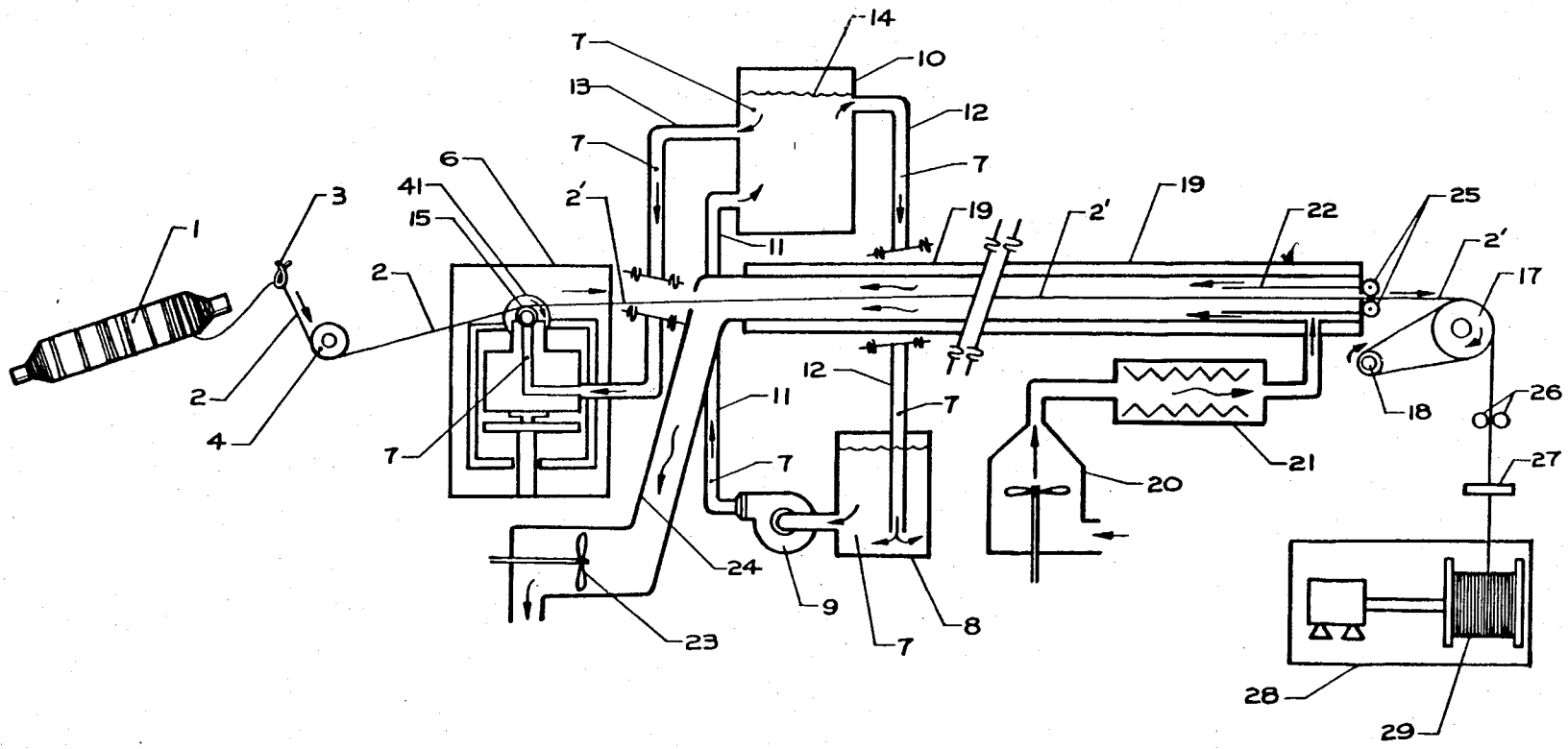
FIG. 1 is a longitudinal schematic of the improved process of the present invention.

FIG. 1 illustrate a schematic of a preferred mode of carrying out the process of the present invention. A bobbin (1) of a nonconductive filamentary polymer substrate (2) is positioned below a pigtail guide (3). The filamentary substrate (2) could be, for example a 20 denier nylon 6 monofilament. The substrate (2) then travels downward and underneath a fixed guide bar (4), following which the yarn is directed upward and into the groove (5) (shown only in FIGS. 4 and 5) of a grooved roll-type coating applicator (6). An improved mix (7) is held in a holding tank (8) and is pumped upward (via pump 9) to a "head tank" (10) via a pump conduit (11). The mix (7) is pumped into the head tank (10) at such a rate that the head tank is filled to the point of continuously overflowing back into the holding tank (8) via a return conduit (12). The head tank (10) therefore maintains a constant level (14) of mix (7) therein, and the head tank (10) therefore supplies a constant and continuous pressure of mix to the mix applicator (6), via supply conduit (13). The mix (7) goes into the applicator (6), the mix then being forced up into the grooves (5) (shown only in FIGS. 4 and 5) which are on a grooved roller member (15) which is the most critical element of the roll-type mix applicator (6). The Inner Surface of the Stator (40) (see FIG. 2) keeps the mix (7) confined to the grooves (5) on the roller member. The substrate is forwarded at a speed of at least 500 meters per minute by a pair of drive rollers (17) and (18), while the surface speed of the roller member (15) remains about 12 meters per minute. The roller (15) is driven by a motor (41). The substrate (2) continuously sweeps away the mix in the groove as the mix is being brought to a point at which the substrate (2) makes initial contact with the groove. After the substrate (2) has left the surface of the grooved roller members (15), the now mix-coated substrate (2') enters the upstream end of the evaporation tube (19). The mix (7) suffuses into the mix-coated substrate (2') as the substrate (2') enters and travels through the evaporation tube (19). The volatile components within the mix flash off of the coated substrate (2') as the coated substrate is subjected to hot counter-current airflow. The airflow is counter-current to the direction of yarn travel, as indicated by "wavy" arrows in FIG. 1. The hot airflow is created by a compressor (20) in conjunction with an electrical heater (21), the hot compressed air being forced around an interior tube (22), the interior tube (22) being within the evaporation tube (19). The interior tube (22) creates a venturi effect which draws outside air into the upstream end of the evaporation tube (19). Coupled with compressor (20) is an exhaust fan (23) and exhaust duct (24) which carries the solvent laden air from the drying tube (19) to an external destination, i.e., solvent gases are directed outside of the building which houses the process, or to a trap (not shown) for recovery. The downstream end of the drying tube (19) has a small slit (approximately 0.25 inches wide) which is bounded by cylindrical bars (25) which provide a smooth, wear-resistant surface should the substrate (2') ever get out of a lignment. In FIG. 1 the direction of hot air flow is indicated by "wavy" arrows. The direction of yarn flow is indicated by the "straight" arrows and the arrows indicating the direction of rotation of feed rolls (17) and (18). After the largely solvent-free substrate (2') is forwarded past the guide bars (25), the substrate (2') then passes several times around feed rolls (18) and (17), and then travels past two pairs of guide bars (26) and (27) which are oriented 90° from one another, causing the substrate to be properly aligned before being taken up by a winder (28) which forms a bobbin (29).

Figure 3:
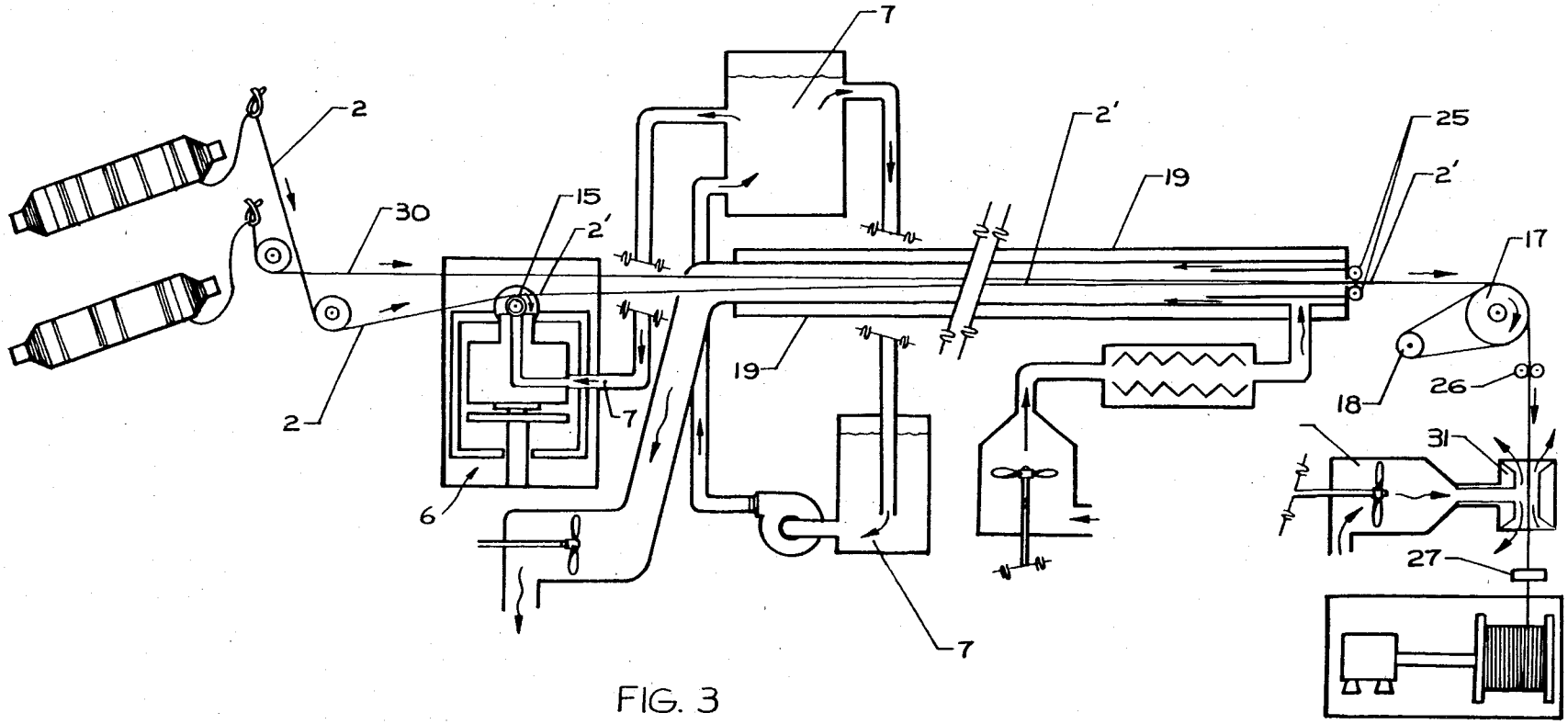
FIG. 3 is a longitudinal schematic of a second embodiment of the improved process of the present invention.

FIG. 3 illustrates an alternative embodiment of the process of the present invention, wherein the filamentary polymer substrate (2) is processed exactly as in FIG. 1, except that a support yarn (30) is fed into the evaporation tube (19) alongside, but slightly spaced from, the coated filamentary substrate (2') which has passed through the groove of the roller member (15). The support yarn (30) does not come into contact with mix 7 (i.e. the mix-control substrate (2')) until after substantially complete evaporation of solvents from the coated substrate (2'). The support yarn (30) contacts the filamentary substrate (2') shortly before (or even at) the point at which the substrate (2') contacts the first feed roll (17). From here the combined substrate (2') and support yarn (30) proceed exactly as illustrated in FIG. 1 except that the substrate (2') is interlaced with the support yarn (30) by an interlacer (31) which is positioned between the two pairs of alignment guides (26) and (27). The interlacer (31) is most preferably supplied with a source of compressed air from a compressor (32). The direction of gaseous flow is shown by the arrows in the vicinity of compressor (32) and interlacer (31). The interlaced combination of the substrate (2') and the support yarn (30) is then wound up onto a bobbin.

It has been unexpectedly found that a particular group of mix formulations is highly advantageous in the use of the roll coater in the process of the present invention. The mix formulations have been found to provide advantages in carrying out the process of the present invention in enabling a higher yarn throughput speed and/or shorter drying tube length, due to higher volatility of the solvent compounds while enabling the use of a roll-type mix applicator for extended periods, which enables process advantages in that a process which is closer to being completely continuous can be performed.

Some of the solvents which may be used in the present invention are flammable. Use of these solvents requires the presence of relatively expensive explosion-proof equipment. However, many of these flammable solvents have desirable volatility characteristics in that they are very easily evaporated.

Several of the solvents are not flammable, and for this reason are most preferred. Examples of these solvents are acetic acid, dimethylformaide and dimethylacetamide. If one of the most preferred solvents is utilized, it is also most preferred that the solvent mixture comprises between 20% and 40% formic acid. Furthermore, when carrying out the process on monofilaments which are between 7 denier and 20 denier, it is most preferred that the mixture comprises between 20% and 30% formic acid. If the process is being carried out on monofilaments between 20 denier and 120 denier, it is most preferred that the solvent mixture comprises between 30% and 40% formic acid.

Preferably the mix further comprises between 0.1% and 5% of a dissolved polymer which is compatible with the polymer from which the polymeric substrate is made. As used herein, the phrase "compatible polymers" is defined as polymers which are mutually soluble in the same solvent. For example, a nylon 6,6 polymeric substrate has been sucessfully coated with a mix which utilized dissolved nylon 6 polymer.

Most preferably the mix comprises between 0.1% and 5% of a "corresponding polymer", i.e., the polymer dissolved in the mix is the same chemical species as the polymer from which the polymeric substrate is made. The most preferred polymeric substrate is made of nylon 6 polymer, and of course the most preferred polymer for the mix is therefore nylon 6 polymer.

The roll coater is preferably designed in order to apply a consistently uniform amount of mix to the substrate over a long period of time, without leaking mix and without allowing the mix to dry on the roller. As shown in FIG. 2, a preferred roll coater is comprised of a grooved roller member (15), a stator member (40), and a motor (41) for rotation of the roller member (15). The roller (15) preferably has a Rulon TM surface. Rulon TM is a fiberglass-reinforced polytetrafluoroethylene composite, and has proven to be very wear-resistant in the processes described herein. The stator (40) is preferably made of a hard metal such as stainless steel. As shown in FIGS. 1 and 3 there is a constant flow of mix being supplied to the grooved roll-coater. The mix travels through stator support block (42) (shown in FIG. 2), up through the stator member (40) itself, and finally into the groove of the grooved roller member (15), and is finally swept onto the traveling filamentary substrate (not shown in FIG. 2).

FIG. 2 represents a cross-sectional view of the mix applicator (6) utilized in the process of the present invention. A motor (41) is supported by an upper section (47) of a rigid structural assembly. The motor (41) in turn supports and rotates the grooved roller member (15). A pneumatic cylinder (43) is attached to a lower section (48) of the rigid structural assembly. The cylinder (43) has a piston (45) which is attached to a stator support block (42). The stator support block in turn is attached to the steel stator member (40). In the examples below, the piston usually exerts about 15 pounds of force on the stator support block (see arrows 46) which the stator member (40) then exerts on the roller member (15). The surfaces of the stator member (40) and the roller member (15) are smooth so that mix (7) which flows through the stator support block (42) and the stator member (40) is prevented from accumulating on the main surface of roller member 15 i.e. the mix is allowed to go only into grooves (5) (see FIGS. 4 and 5) of the roller members (15). Compressed air is supplied to the pneumatic cylinder (43) via line (44).

The roll coater (6) should be designed as that the mix is not actively forced through the groove, but rather just flows into the groove. If the groove is too large or the head pressure is too high, the mix will be literally forced "through" the groove and may even "squirt" out of the groove, both which are highly undesirable. If the groove size is too small, the roll coater may have to be rotated so fast that the mix will be slung out of the groove by centrifugal force. Thus the groove size, mix pressure, and mix viscosity are important process parameters. Optimizing these parameters for any given system can easily be accomplished from a review of the examples herein together with applying ordinary engineering principles concerning fluid flow.

FIG. 4 illustrates a longitudinal perspective view of the roller member (15). The particular roller member illustrated in FIG. 4 has 6 grooves (5) therein. Also illustrated in FIG. 4 are certain parameters related to the roller member, such as (a) GS: groove spacing; (b) D: roller diameter; (c) L: roller length.

FIG. 5 is an enlarged view of a small portion of the roller member (15). Surfaces (5) define a groove which has an apex angle of 60°, as illustrated. FIG. 5 also defines the parameters of (a) GD: groove depth; (b) GW: groove width. It has been conceived that the groove depth may range from 0.010 inches to 0.030 inches.

In the process of using the roll coater, the traveling substrate continuously sweeps the mix-filled groove substantially clean as the groove carries mix up to the point at which the traveling substrate comes into contact with the roller. The surface speed of the roller together with the cross sectional area of the groove determine the amount of mix available for the traveling substrate to pick up. The roller should not have so small a diameter that a high RPM is necessary, as the certrifugal forces on the mix can become so high that the roller will sling the mix from the roll. In addition, the cross-sectional area of the groove should be sized so that a suitable amount of mix will be supplied to the substrate. The cross-sectional shape of the groove is generally in the shape of a "V". It has been conceived that the apex angle of the "V" may vary greatly, and it has been proven that the "V" may have an apex angle that can vary from 60° to 90°. For filaments of 150 denier to 2000 denier a 90° angle is preferred while for filaments of 5 denier to 150 denier a 60° angle is preferred. It has been conceived that an apex angle between 50° and 100° will be operable. However, it has been conceived that any groove shape may be utilized so long as it does not tend to grab the yarn and so long as it makes enough mix available to the yarn. Preferred roller rotation rates, roller diameters, groove shapes, and groove sizes are given in the Examples below. It has been conceived that the diameter of the grooved roller may vary from 0.75 inches to 3.0 inches.

The process of the present invention has been carried out utilizing filaments having deniers from 7 to 2000. However, it has been conceived that the process is operable over the denier range of 5 to 5000.

The evaporation tube has a counter-current flow of hot air therethrough. The evaporation tube most preferably has an inside diameter of between 1 inch and 3 inches and may have a length between 3 and 100 feet, but most preferably is between 10 and 20 feet in length, and most preferably is about fifteen feet in length. The hot air supplied to the evaporation tube preferably has a temperature between 100° C. and 200° C.

The air interlacer (31) utilized to entangle the support yarn (30) with the substrate (2), as shown schematically in FIG. 3, has a straight, round yarn throughput hole with a diameter of 0.125 inches. The interlacer has a fluid jet orifice which intersects the throughput hole at 90°. The round fluid jet orifice has a diameter of 0.0625 inches. Air pressures from 40 psig to 100 psig are operable.

EXAMPLE I

Prior Art

A cold-stretched 15 denier nylon 6 monofilament having a circular cross-sectional diameter of 42 microns was continuously directed at a rate of 400 meters per minute from a source of supply through the interface of two opposing surfaces of a polyester pad which was kept saturated with:

| | | |
|---|---|---|
| (a) | carbon black (30 millimicrons) | 5%; and |
| (b) | powdered nylon 6 substrate | 5%; and |
| (c) | formic acid (80%, aqueous;) | 72%; and |
| (d) | water | 18% |

Thereupon, the filament was conducted into and through a 20 foot-long, substantially horizontally positioned elongated chamber in which the air at room temperature was continuously exchanged by means of air jets and exhaust openings. Removal of the volatile formic acid was thereby accomplished, and the filament was substantially dry. After exiting the elongated chamber, the filament was continuously wound onto a package at a rate of 400 meters per minute.

After 1–2 hours of continuous processing, the pad was observed to be scraping (actually doctoring) off the vast majority of the mix from the filament. Investigation into this phenomena revealed that the mix-saturated pad exposed the mix to the air in the vicinity of the point at which the filament exited the pad. The formic acid had evaporated from the mix at this point, causing the nylon 6 to precipitate out of the solution. This nylon 6 formed an effective surface for virtually complete doctoring of mix from the surface of the mix-coated filament. The solution to this problem was to frequently replace the polyester pads which was inconvenient, time, consuming, and expensive.

EXAMPLE II

Comparative

The process illustrated in FIG. 1 was carried out using a 20 denier nylon 6 monofilament. The monofilament was offwound from a pirn at a rate of 2500 meters per minute. As the monofilament was offwound it traveled up to a pigtail guide and then proceeded down and underneath a guide bar and then up and into contact with the mix-filled groove of the roll-type mix applicator as shown in FIG. 1. The mix comprised:

| | | |
|---|---|---|
| (a) | carbon black (30 millimicrons) | 5%; and |
| (b) | powdered nylon 6 polymer | 5%; and |
| (c) | formic acid | 72%; and |
| (d) | water | 18% |

The roller had a diameter of 1 inch, and the V-shaped groove had a maximum width of 0.023 inches and a depth of approximately 0.020 inches. The roller had a steel core and a Rulon TM outer layer which was 0.125 inches thick. The roller was rotated at approximately 150 rpm. The monofilament was processed satisfactorily for up to 10 minutes, after which time the monofilament would consistently break in the drying tube. The evaporation tube had counter current airflow forced therethrough, as indicated in FIGS. 1 and 3. The evaporation tube was substantially horizontally positioned. The air had a temperature of approximately 150° C. The evaporation tube had an inside diameter of 2.5 inches, and the hot air was forced through the tube at a rate of 700 feet per minute. A careful examination of the product revealed that there was an extremely uneven deposition of the mix on the strand. It was surmised that the acid in the mix would dissolve the strand to a degree which would result in strand breakage due to the fact that surprisingly the mix was found to have been applied very heavily on distinct areas of the surface of the strand. The excess acid in these areas was believed to have caused excessive strand weakening.

EXAMPLE III

The process was carried out exactly as described in Example II, except that the mix contained:

| | | |
|---|---|---|
| (a) | carbon black (30 millimicrons) | 3.8%; and |
| (b) | powdered nylon 6 | 2.3%; and |
| (c) | formic acid | 21.1%; and |
| (d) | acetic acid | 72.8%. |

The process was run continuously for more than 24 hours, during which time the roll-coater tolerated the passage of slubs and knots due to transfer tailing of the monofilament. Surprisingly, the monofilament was evenly coated with the mix and the roller did not have any buildup of mix thereon. The resulting resistance of the filament was about $5\times10^5$ ohms/cm. The product was considered to be of excellent quality for antistatic textile purposes.

EXAMPLE IV

The process was carried out similarly to the process described in Example III except that a 7 denier nylon 6 monofilamentary polymeric substrate was subjected to the mix. The roller rotated at about 100 rpm. A 20 denier/8 filament support yarn was directed through the drying tube as shown in FIG. 3. The substrate first touched the support yarn at the first feed roll. Both yarns were forwarded at about 2500 meters/minute. After both yarns passed through the feed rolls they went through a guide and are then interlaced together. The interlacer has a circular yarn throughput hole with a diameter of 0.125 inches and a length of 1.25 inches. The air jet orifice has a diameter of 0.0625 inches. The axis of the jet orifice hole intersects the axis of the yarn throughput hole at an angle of 90 degrees. The air jet orifice is supplied with 90 psi of compressed air. The interlaced product is then wound up at 2500 meters per minute. Just as in Example III, the process is performed satisfactorily for more than 24 hours, uninterrupted.

EXAMPLE V

A process was carried out substantially as shown in FIG. 1 except that instead of running only 1 monofilamentary substrate through the evaporation tube, ten 15-denier monofilaments were simultaneously coated on 1 roll coater and sent through a single evaporation tube. The roller was exactly as described in Example II except that it had 10 grooves thereon which were spaced ¼" apart. The roller rotated at 100 rpm. The mix was exactly as used in Example III. The monofilaments were forwarded at a speed of 1500 meters per minute. The resulting filaments are interlaced together by the same interlacing process described in Example IV. The interlaced product is then wound up at 1500 meters per minute. Just as in Example III, the process runs uninterrupted for more than 24 hours.

EXAMPLE VI

A 2000 denier nylon 6,6 monofilamentary substrate was forwarded at a speed of approximately 600 feet per minute in a process similar to the process described in Example III. However, the roll coater has a groove which had a depth of 0.025 inches, and the groove had a maximum width of 0.050 inches (i.e. the surfaces forming the sides of the groove met at a 90° angle). The mix used was the same as in Example III. The counter-current air which was forced through the evaporation tube had a temperature of approximately 200° C. The rate of flow of air through the evaporation tube was 600 feet per minute, and the inside diameter of the evaporation tube was 2.5 inches. The 2000 denier substrate was processed continuously for a period of 1.5 hours without interruption. The resulting 2000 denier antistatic/conductive product had a resistance of 10,000 ohms per centimeter and was considered excellent for applications requiring an antistatic filament of this size.

We claim:

1. In a process of preparing an electrically conductive textile fiber from a moving non-conductive, filamentary polymer substrate in which a dispersion of finely-divided electrically-conductive particles is applied to the filamentary substrate in an amount sufficient to render the electrical resistance of the textile not more than about $10^9$ ohms/cm. in a liquid which is a solvent for the substrate but does not react with the electrically conductive particles, and the solvent is removed from the substrate after a desired degree of penetration has taken place in the annular region located at the periphery of the filament and before the structural integrity of the substrate has been destroyed, the improvement which comprises:

applying a mix to the nonconductive filamentary substrate with a grooved, roll-type mix applicator, the mix being comprised of a dispersion of electrically conductive particles in a liquid solvent wherein the liquid solvent will dissolve the substrate and will flash evaporate at 150° C., and wherein the solvent is a mixture of formic acid and a member selected from the group consisting of:

(a) an amide;
(b) a carboxylic acid other than formic acid;
(c) an alcohol;
(d) an ester;
(e) a ketone;
(f) an ether; and
(g) a hydrocarbon.

2. A process as described in claim 1 wherein the solvent is a mixture of formic acid and a member selected from the group consisting of (a) dimethylformamide; (b) dimethylacetamide; and (c) acetic acid, the mix further comprising between 0.1% and 5% compatible polymer dissolved in the solvent.

3. A process as described in claim 2 wherein the solvent is a mixture of formic acid and acetic acid, and the solvent mixture comprises between 20% and 30% formic acid, and the filamentary polymer substrate is a monofilament having a denier between 7 and 20.

4. A process as described in claim 2 wherein the solvent is a mixture of formic acid and acetic acid, and the solvent mixture comprises between 30% and 40% formic acid, and the filamentary polymer substrate is a monofilament having a denier between 20 and 120.

5. A process as described in claim 2 wherein the filamentary polymeric substrate is forwarded at a speed greater than 2000 meters per minute.

6. A process as described in claim 2 wherein the solvent is a mixture of formic acid and acetic acid, and the acidic solvent mixture comprises between 20% and 40% formic acid.

7. A process as described in claim 6 wherein said compatible polymer is a corresponding polymer.

8. A process as described in claim 7 wherein both the filamentary polymer substrate and the corresponding polymer are nylon 6.

9. A process as described in claim 1 wherein the filamentary polymeric substrate is forwarded at a speed of at least 500 meters per minute.

10. A process as described in claim 1 wherein the solvent is removed from the filamentary polymeric substrate while the substrate is being forwarded in a substantially horizontal position.

11. A process as described in claim 1 wherein a supporting multifilamentary substrate is interlaced with the filamentary polymeric substrate after said solvent is removed.

12. A process as described in claim 1 wherein the roll-type mix applicator comprises a grooved roller member, the grooves of which a "V" cross-section and have both an apex angle between 50 and 100 degrees, and a depth between 0.010 inches and 0.030 inches.

13. A process as described in claim 12 wherein the grooved roller member has a diameter between 0.75 inches and 3.0 inches.

14. A process as described in claim 1 wherein the substrate has a denier between 5 and 5000.

15. A process as described in claim 1 wherein an evaporation tube and a counter-current flow of air having a temperature between 100° C. and 200° C. are utilized for solvent removal.

16. A process as described in claim 15 wherein the evaporation tube has a length between 10 and 20 feet.

17. A process as described in claim 1 wherein the roll-type mix applicator comprises a grooved roller member which has an outer surface made from a fiberglass-reinforced polytetrafluoroethylene material.

18. A process as described in claim 17 wherein the roll-type mix applicator comprises a steel stator member.

* * * * *